US008678867B2

(12) United States Patent
Glick et al.

(10) Patent No.: US 8,678,867 B2
(45) Date of Patent: Mar. 25, 2014

(54) ELECTRICAL TERMINAL AND RECEPTACLE ASSEMBLY

(75) Inventors: Michael Glick, Farmington Hills, MI (US); Slobodan Pavlovic, Novi, MI (US); Allen Leo Mott, Livonia, MI (US); Reshma Rathod, Auburn Hills, MI (US)

(73) Assignee: Lear Corporation, Southfield, MI (US)

( * ) Notice: Subject to any disclaimer, the term of this patent is extended or adjusted under 35 U.S.C. 154(b) by 205 days.

(21) Appl. No.: 13/285,384

(22) Filed: Oct. 31, 2011

(65) Prior Publication Data

US 2013/0109237 A1 May 2, 2013

(51) Int. Cl.
*H01R 13/187* (2006.01)

(52) U.S. Cl.
USPC ..... 439/843

(58) Field of Classification Search
USPC ..... 439/843–847, 827, 607.17, 357
See application file for complete search history.

(56) References Cited

U.S. PATENT DOCUMENTS

| | | | | |
|---|---|---|---|---|
| 3,161,451 | A | 12/1964 | Neidecker | |
| 3,763,460 | A * | 10/1973 | Hatschek et al. | 439/277 |
| 4,373,262 | A | 2/1983 | Blakesley | |
| 4,606,599 | A | 8/1986 | Grant et al. | |
| 4,714,441 | A | 12/1987 | Corman | |
| 4,753,616 | A * | 6/1988 | Molitor | 439/787 |
| 5,591,039 | A | 1/1997 | Matthews | |
| 5,667,413 | A * | 9/1997 | Trafton | 439/843 |
| 5,730,628 | A * | 3/1998 | Hawkins | 439/843 |
| 6,042,432 | A | 3/2000 | Hashizawa et al. | |
| 6,048,225 | A | 4/2000 | Dechanteloup et al. | |
| 6,102,751 | A | 8/2000 | Becker | |
| 6,190,215 | B1 | 2/2001 | Pendleton et al. | |
| 6,250,974 | B1 * | 6/2001 | Kerek | 439/843 |
| 6,254,439 | B1 | 7/2001 | Endo et al. | |
| 6,264,508 | B1 | 7/2001 | Lehmann | |
| 6,811,453 | B2 | 11/2004 | Williams | |
| 6,837,756 | B2 * | 1/2005 | Swearingen et al. | 439/843 |
| 7,101,192 | B1 | 9/2006 | Bordeau et al. | |

(Continued)

FOREIGN PATENT DOCUMENTS

| | | | |
|---|---|---|---|
| DE | 102009044179 | A1 | 12/2010 |
| WO | 2010060370 | A1 | 6/2010 |
| WO | 2010128263 | A1 | 11/2010 |

OTHER PUBLICATIONS

International Search Report and Written Opinion for corresponding PCT Application No. PCT/US2012/050713, mailed Jan. 7, 2013, 15 pages.

(Continued)

*Primary Examiner* — Neil Abrams
*Assistant Examiner* — Travis Chambers
(74) *Attorney, Agent, or Firm* — Brooks Kushman P.C.

(57) ABSTRACT

A terminal is provided with a body sized to be received within a receptacle. A distal region extends lengthwise from the body in a receptacle direction. At least one portion of the distal region extends centrally inward into the receptacle to receive a pin to deform and maintain contact with the received pin. A lengthwise extending proximal region is connected to the body and spaced apart from the distal region. At least one portion of the proximal region extends radially outward to engage a side wall of the receptacle to enhance contact of the terminal with the receptacle. A receptacle assembly is provided for receiving one or a plurality of terminals.

17 Claims, 5 Drawing Sheets

(56) References Cited

U.S. PATENT DOCUMENTS

| | | | |
|---|---|---|---|
| 7,393,252 | B2 | 7/2008 | Ribeau et al. |
| 7,416,453 | B2 | 8/2008 | Germani |
| 7,537,472 | B1 | 5/2009 | Schwarz et al. |
| 7,578,708 | B2 | 8/2009 | Hachadorian |
| 7,828,609 | B2 | 11/2010 | Li et al. |
| 7,841,912 | B2 | 11/2010 | Hachadorian |
| 7,909,236 | B2 | 3/2011 | Erdie |
| 7,927,127 | B1 | 4/2011 | Glick et al. |
| 7,963,793 | B2 | 6/2011 | Poulin et al. |
| 7,972,167 | B2 | 7/2011 | Amit et al. |
| 8,078,280 | B2 | 12/2011 | Sage |
| 8,096,829 | B2 | 1/2012 | Malloy et al. |
| 2002/0122690 | A1 | 9/2002 | Poon et al. |
| 2003/0040228 | A1 | 2/2003 | Finzer et al. |
| 2003/0163171 | A1 | 8/2003 | Kast et al. |
| 2008/0254670 | A1 | 10/2008 | Balsells et al. |
| 2010/0311266 | A1 | 12/2010 | Dilmaghanian et al. |
| 2011/0028051 | A1 | 2/2011 | Heigl et al. |
| 2011/0034053 | A1 | 2/2011 | Matsumoto et al. |
| 2011/0171850 | A1 | 7/2011 | Brown, II |
| 2011/0201223 | A1 | 8/2011 | Kurumizawa et al. |

OTHER PUBLICATIONS

U.S. Appl. No. 13/214,376, filed Aug. 22, 2011, 23 pages.
U.S. Appl. No. 13/285,393, filed Oct. 31, 2011, 18 pages.
U.S. Appl. No. 13/101,592, filed May 5, 2011, 23 pages.

* cited by examiner

ELECTRICAL TERMINAL AND RECEPTACLE ASSEMBLY

TECHNICAL FIELD

Various embodiments relate to electrical terminals for facilitating electrical connectivity, and receptacle assemblies comprising electrical terminals.

BACKGROUND

Electrical terminals are used in a number of applications to facilitate electrical connecting of one element to another. Some electrical terminals may be configured to facilitate use with a removable connector of the type that may be repeatedly inserted and removed or otherwise configured to repeatedly engage and disengage the electrical terminal. The ability of the electrical terminal to facilitate electrical connectivity with such a removable connector can be problematic if an electrical connection area between the terminal and connector has poor connectivity, particularly when tolerance variations or degradation from repeated use causes a mating arrangement between the components to become loose or otherwise insecure.

DETAILED DESCRIPTION

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

Figure 1:
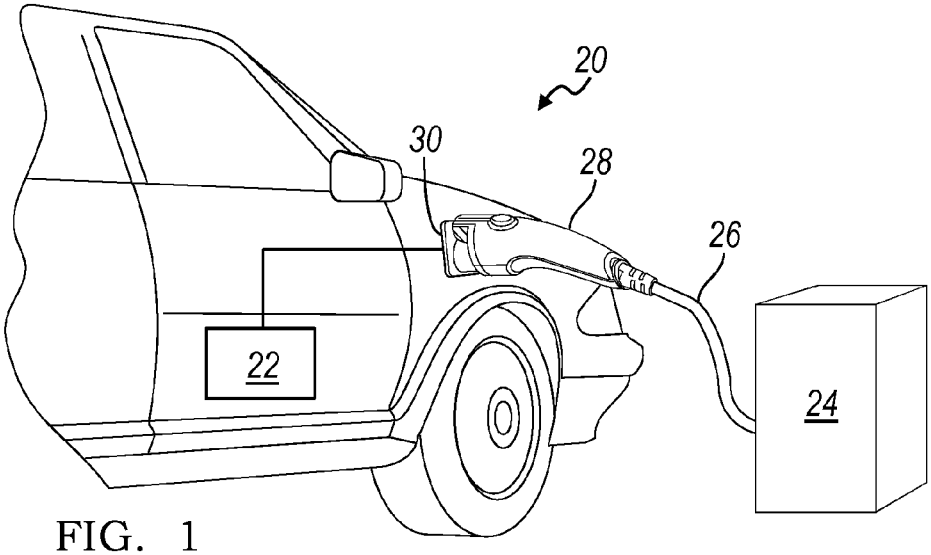
FIG. 1 is a schematic of a charging system utilizing a charging connector assembly according to an embodiment.

FIG. 1 illustrates a charging system 20 operable to facilitate charging of a vehicle charging system 22 with energy provided from a wall outlet or charging station 24 as contemplated according to an embodiment. The system 20 may include a cordset 26 having plurality of conducting wires and/or other conducting elements to facilitate delivering current between the charging station 24 and the vehicle charging system 22. One end of the cordset 26 may include a connector assembly 28 configured to be received within a charging receptacle 30 associated with the vehicle charging system. The connector assembly 28 may be of the type described in U.S. Pat. No. 7,878,866 to Kwasny et al., the disclosure of which is hereby incorporated by reference in its entirety.

The charging receptacle 30 may be configured to facilitate establishment of an electrical connection between a plurality of electrically conducting elements of the vehicle charging system 22 and the charging station 24. The charging receptacle 30 may facilitate the desired electrical connection by providing interconnecting conducting elements and/or by guiding the vehicle charging system 22 and conducting elements of the connector assembly 28 into a mating arrangement with each other. The charging receptacle 30 may be configured to support a multiple pin or port connection methodology for facilitating electrically interconnecting the vehicle charging system 22 and the conducting elements of the connector assembly 28, including but not limited to that specified in Society of Automotive Engineer (SAE) J1772 and International Electrotechnical Commission (IEC) 51851.

Figure 2:
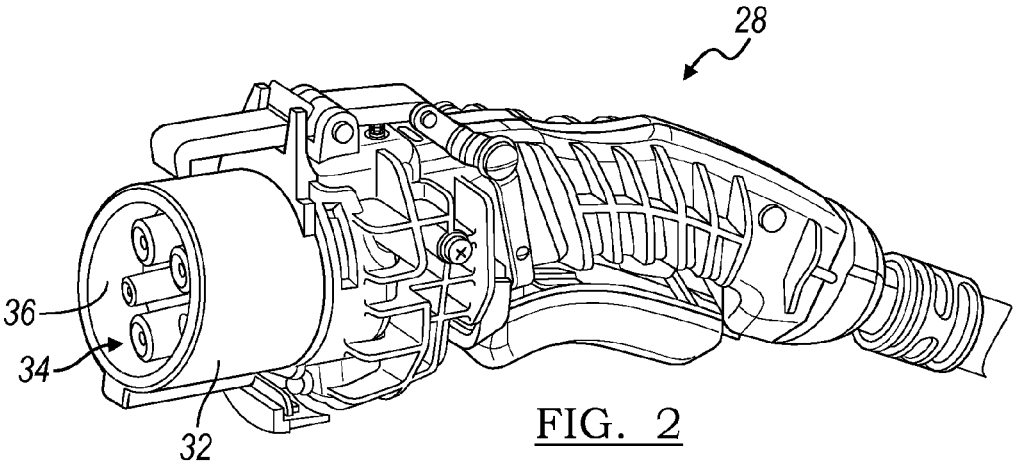
FIG. 2 is a partially disassembled perspective view of the charging connector assembly of FIG. 1, utilizing a plurality of receptacle assemblies.

FIG. 2 illustrates the connector assembly 28 with a male charging connector 32 for receipt within the receptacle 30. The illustrated charging connector 32 may be configured to facilitate electrically interconnecting vehicle charging system conducting elements with conducting elements of the cordset 26 by guiding the elements into engagement with each other. The charging connector assembly 28 may include a plurality of female receptacle assemblies 34 for receiving pins their within the charging receptacle 30. The receptacle assemblies 34 are oriented within a cavity 36 of the connector 32 and may be configured to facilitate interconnecting of pins within the charging receptacle 30 with wires included within the cordset 26.

The charging system 20 and the particular components disclosed in FIGS. 1 and 2 are for example only and depict one embodiment for utilizing the receptacle assemblies 34. Of course, the receptacle assemblies 34 may be employed at any electrical connection wherein a female receptacle receives a pin.

Figure 3:
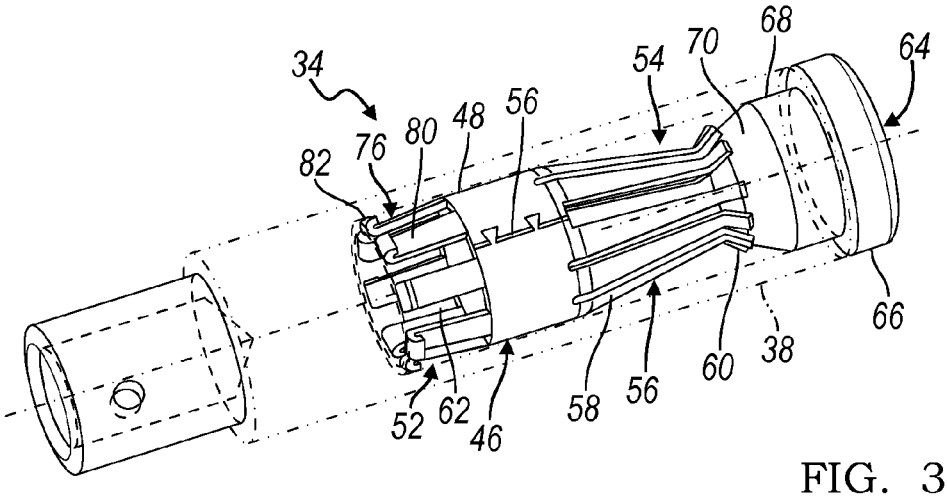
FIG. 3 is a side perspective view of one of the receptacle assemblies of FIG. 2.
Figure 4:
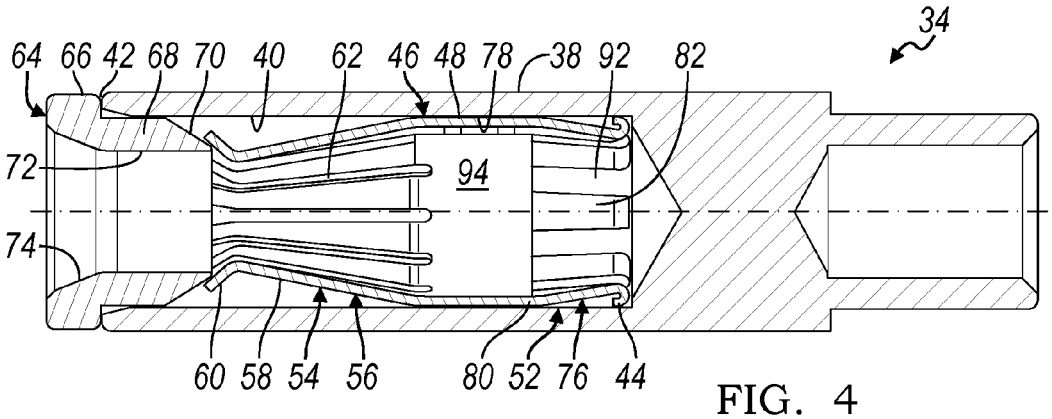
FIG. 4 is a side section view of the receptacle assembly of FIG. 3.

Referring now to FIGS. 3 and 4, the receptacle assembly 34 is illustrated with a receptacle housing 38. The receptacle housing 38 may be similar to an embodiment disclosed in U.S. patent application Ser. No. 13/214,376 filed on Aug. 22, 2011 by Mott et al., which is incorporated by reference herein. The receptacle housing 38 has a bore or receptacle 40 formed therein. The receptacle 40 has an opening 42 and a blind depth end 44. The receptacle housing 38 may be generally hollow and cylindrical in shape. Of course, the housing 38 may have any suitable shape, such as a reduced diameter, and is not limited to having a blind depth. The housing 38 may be formed of any suitable material, such as a conductive material that is adequately rigid. According to another embodiment, the receptacle housing 38 may be insulated on its exterior.

An electrically conductive terminal 46 is received within the receptacle 40. In the depicted embodiment, the terminal 46 contacts the receptacle 40 for providing an electrical connection between the terminal 46 and the receptacle 40. The terminal 46 is illustrated removed from the receptacle housing 38 in FIG. 5.

Figure 5:
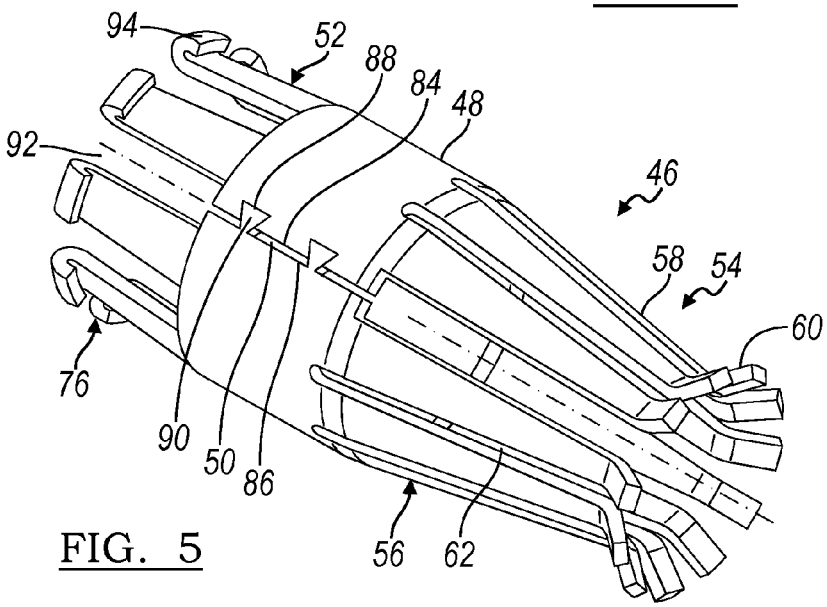
FIG. 5 is a side perspective view of a terminal of the receptacle assembly of FIG. 3.

Referring now to FIGS. 3-5, the terminal 46 has a generally cylindrical body 48 that is received within the receptacle 40. The terminal 46 may be formed of an electrically conductive spring metal, such as a spring tempered alloy or a binary metal such as copper clad steel. The body 48 has a lengthwise slit 50 formed through the body 48. In the depicted embodiment a proximal region 52 of the body 48 of the terminal 46 is installed against the blind depth end 44 of the receptacle 40. Additionally, the terminal 46 may be bonded to the receptacle housing 38 by sonic welding or any suitable manufacturing process.

The terminal 46 has a distal region 54 with a plurality of beams or leaf springs 56 oriented generally in a radial array and extending lengthwise from the body 48 toward the receptacle opening 42. Each leaf spring 56 has a first angled portion 58 that extends centrally inward and longitudinally away from the body 48. Additionally, each leaf spring 56 has a second angled portion extending radially outward from the first angled portion 58 and extending toward the receptacle opening 42. The leaf springs 56 are spaced apart circumferentially with gaps 62 between consecutive leaf springs 56. Although the first and second angled portions 58, 60 are illustrated and described, any suitable geometry, such as curved leaf springs may be utilized.

The receptacle assembly 34 also includes a retainer 64 secured to the receptacle opening 42 for reducing a diameter of the receptacle opening 42. The retainer 64 may be similar to an embodiment disclosed in U.S. patent application Ser. No. 13/214,376 filed on Aug. 22, 2011 by Mott et al., which is incorporated by reference herein. The retainer 64 may be insulated to prevent inadvertent electrical communication with the opening end of the receptacle housing 38. The retainer 64 has a shoulder 66 abutting the opening 42. The retainer 64 also has a body 68 extending into the receptacle 40 with a tapered surface 70 which may extends centrally within the second angled portions 60 of the leaf springs 56. The retainer 64 has a reduced inner diameter 72 and a leading-edge 74 for guiding a pin (not shown) into the receptacle 44 in engagement with the leaf springs 56 of the terminal 46.

The proximal region 52 also includes a radial array of leaf springs 76 extending in a lengthwise direction from the body 48 toward the blind depth end 44 of the receptacle 40. The leaf springs 76 extend radially outward for engaging a side wall 78 of the receptacle 40. Each leaf spring 76 has a lengthwise extending portion 80 and an angled portion 82. The angled portion 82 extends along an external side of the lengthwise portion 80 to thereby increase an outer diameter of the proximal region 52 of the terminal 46. The outer diameter of the proximal region exceeds an inner diameter of the receptacle 40 so that the angled portions 82 of the leaf springs 76 are each forced into contact with the receptacle due to deformation of the lengthwise portions 80 during installation of the terminal 46 into the receptacle 40. The reaction force of the leaf springs 76 maintains the leaf springs 76 in contact with the receptacle 40. The individual leaf springs 76 create contact point redundancy and improve reliability of the contacts between the terminal 46 and the receptacle housing 38. Additionally, the proximal location of the contact points at the angled portions 82 of the leaf springs 76 shortens the current length along the receptacle housing 38 as opposed to a contact along the body 48.

The terminal 46 may be formed integrally from a single sheet of stamped spring tempered alloy or binary metal. The sheet of material may have a length from the proximal region 52 of the terminal body 48 to the distal end of the pin contact leaf springs 56. The sheet of material may also have a thickness. The sheet of material may have a width terminating at lateral ends 84, 86 that are formed together to collectively provide the slit 50. The sheet of material may be rolled about a lengthwise or central axis of the terminal 46. In order to prevent the body 48 from expanding, and to thereby constrain the body 48 to a particular outer diameter, a pair of interlocking features for the interlocking the lateral ends 84, 86 of the body 48. In the depicted embodiment the interlocking features include a pair of trapezoidal recesses 88 formed into the lateral end 84. A corresponding pair of trapezoidal tabs 90 extend from the lateral end 86 and are received into the trapezoidal recesses 88 for interlocking the lateral ends 84, 86 of the body 48.

The terminal 46 may be utilized in the connector assemblies 28 for vehicle charging systems 22. Such systems often employ high-voltage charging, which is most effective if contact of electrical connections is optimized. Additionally, such vehicle charging systems 22 are exposed to harsh environments and undergo multiple mating cycles. The terminal 46 improves contact of the receptacle housing 38 with the terminal 46 as well as contact of the terminal 46 with the pin 76. These improved contacts improve the durability of the terminal 46 and consequently the durability of the receptacle housings 38 and the connector assembly 28.

The leaf springs 76 of the proximal region are spaced apart circumferentially with gaps 92 in between sequential leaf springs 76. The gaps 92 may be generally equivalent in width to that of the corresponding leaf springs 76. The gaps 92 provide clearance to permit the lengthwise portions 80 converge.

As stated above, the terminal 46 may be formed from a copper clad stainless steel. In such an example, a copper layer 94 is provided on an interior surface of the terminal 46 for enhanced conductivity with the pin. Copper is more conductive that stainless steel, which provides a rigid and flexible structure for the terminal 46. By angling the angled portion 82 of the leaf springs 76 of the proximal region 52, the copper layer 94 is in direct contact with the receptacle housing 38. Therefore, the electrical connection can be conveyed from the pin, through the copper layer 94, directly to the receptacle housing 38 without passing through the less conductive stainless steel.

Figure 6:
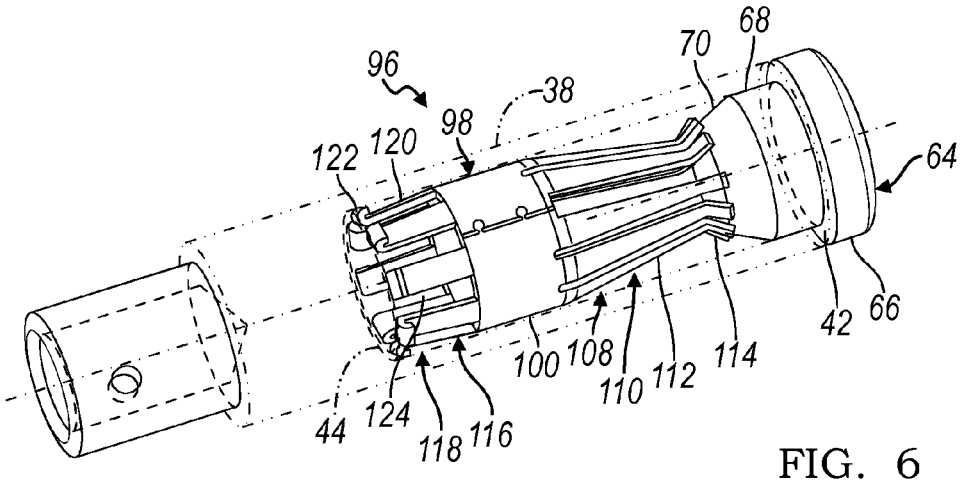
FIG. 6 is a side perspective view of a receptacle assembly of FIG. 2 according to another embodiment.
Figure 7:
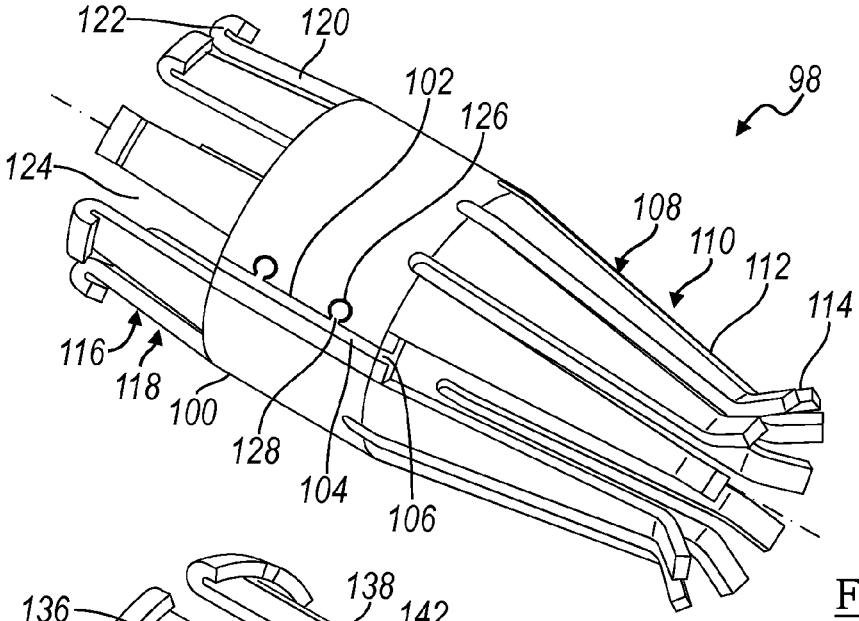
FIG. 7 is a side perspective view of a terminal of the receptacle assembly of FIG. 6.

FIG. 6 illustrates a receptacle assembly 96 according to another embodiment. The receptacle assembly 96 includes a receptacle housing 38 and a retainer 64 as disclosed in the prior embodiment. The receptacle assembly 96 also includes a terminal 98 that is similar to the prior embodiment. The terminal 98 is also illustrated in FIG. 7 and has a body 100 formed from a sleeve with lateral ends 102, 104 interconnected at a slit 106. A radial array of leaf springs 108 extend from the body 100 at a distal region 110 with first and second angled portions 112, 114 for engaging a pin received within the receptacle 40. A second radial array of leaf springs 116 extend from the body 100 at a proximal region 118 with lengthwise portions 120 and angled portions 122 for engaging the side wall 78 of the receptacle 40. The leaf springs 116 are spaced circumferentially by gaps 124. The difference from the prior embodiment is that the lateral ends 102, 104 have an alternative interlocking configuration. The lateral end 102 has a pair of semi-circular recesses 126 formed therethrough; and the other lateral end 104 has a corresponding pair of semi-circular tabs 128 interlocked into the recesses 126. Of course, any suitable interlocking configuration may be employed.

Figure 8:
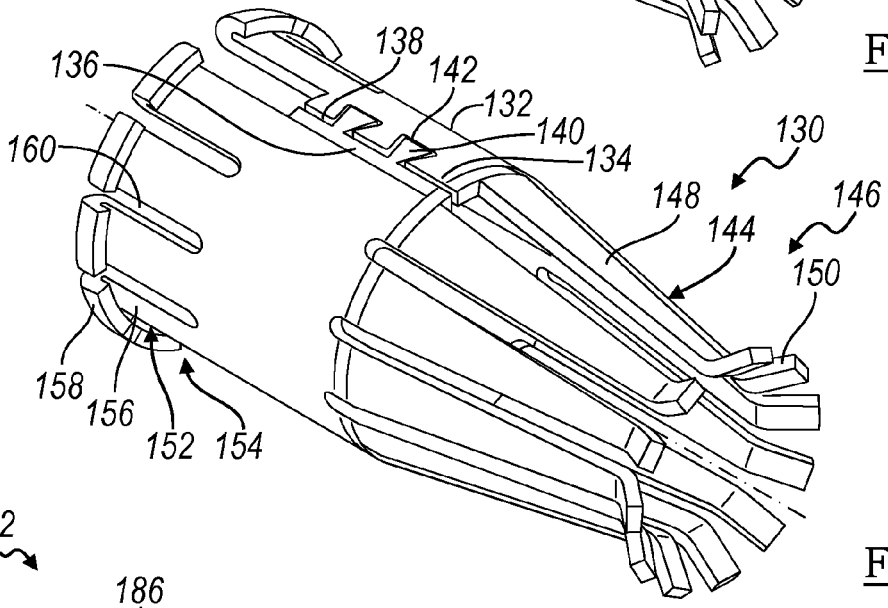
FIG. 8 is a side elevation view of a terminal according to another embodiment.

FIG. 8 illustrates a terminal 130 according to another embodiment. The terminal 130 has a body 132 formed from a sleeve with lateral ends 134, 136 interconnected at a slit 138 by a pair of trapezoidal tabs 140 received in a pair of trapezoidal recesses 142. A radial array of leaf springs 144 extend from the body 132 at a distal region 146 with first and second angled portions 148, 150 for engaging a pin received within the receptacle 40. A second radial array of leaf springs 152 extend from the body 132 at a proximal region 154 with lengthwise portions 156 and angled portions 158 for engaging the side wall 78 of the receptacle 40. The leaf springs 152 are spaced circumferentially by slits 160. In comparison to the prior embodiments, the slits 160 permit more leaf springs 152 and consequently more contact points between the terminal 130 and the receptacle housing 38.

Figure 9:
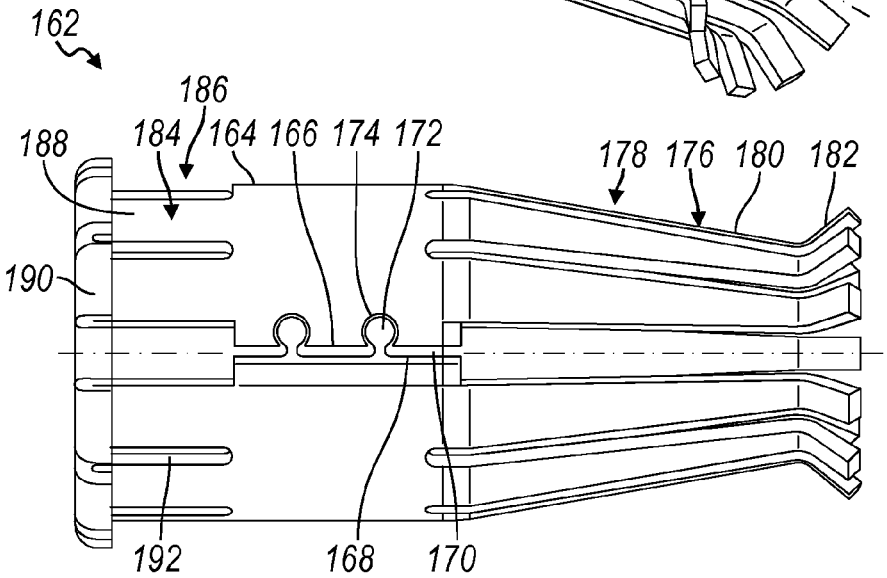
FIG. 9 is a side elevation view of a terminal according to yet another embodiment.

FIG. 9 illustrates a terminal 162 according to another embodiment. The terminal 162 has a body 164 formed from a sleeve with lateral ends 166, 168 interconnected at a slit 170 by a pair of semi-circular tabs 172 received in a pair of semi-circular recesses 174. A radial array of leaf springs 176 extend from the body 164 at a distal region 178 with first and second angled portions 180, 182 for engaging a pin received within the receptacle 40. A second radial array of leaf springs 184 extend from the body 164 at a proximal region 186 with lengthwise portions 188 and angled portions 190 for engaging the side wall 78 of the receptacle 40. The leaf springs 184 are spaced circumferentially by slits 192 for optimizing a quantity of leaf springs 184 and consequently maximizing contact points between the terminal 162 and the receptacle housing 38.

Figure 10:
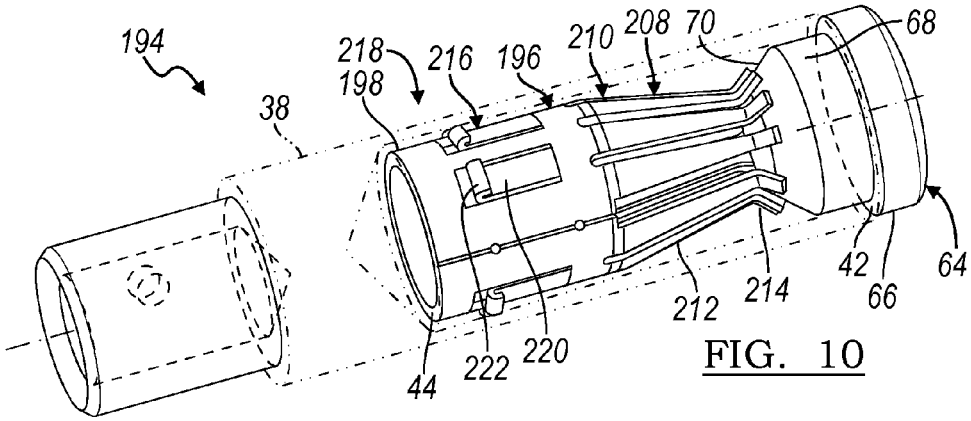
FIG. 10 is a side perspective view of a receptacle assembly of FIG. 2 according to yet another embodiment.
Figure 11:
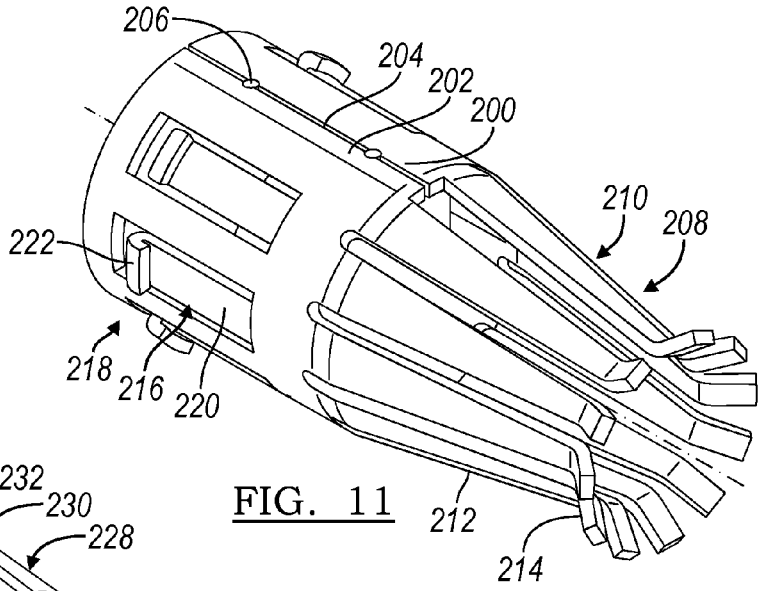
FIG. 11 is a side perspective view of a terminal of the receptacle assembly of FIG. 10.

FIG. 10 illustrates a receptacle assembly 194 according to another embodiment. The receptacle assembly 194 includes a receptacle housing 38 and a retainer 64 as disclosed in prior embodiments. The receptacle assembly 194 also includes a terminal 196 that is similar to prior embodiments. The terminal 196 is also illustrated in FIG. 11 and has a body 198 formed from a sleeve with lateral ends 200, 202 interconnected at a slit 204 by a fastener, such as laser-spot welding 206. A radial array of leaf springs 208 extend from the body 198 at a distal region 210 with first and second angled portions 212, 214 for engaging a pin received within the receptacle 40. A second radial array of leaf springs 216 are formed into the body 198 at a proximal region 218 thereof, with lengthwise portions 220 and angled portions 222 for engaging the side wall 78 of the receptacle 40. The leaf springs 216 are spaced circumferentially about the body 198. By orienting the leaf springs 216 about the body 198, the proximal region 218 and the body 198 are combined, thereby minimizing materials while optimizing conductivity.

Figure 12:
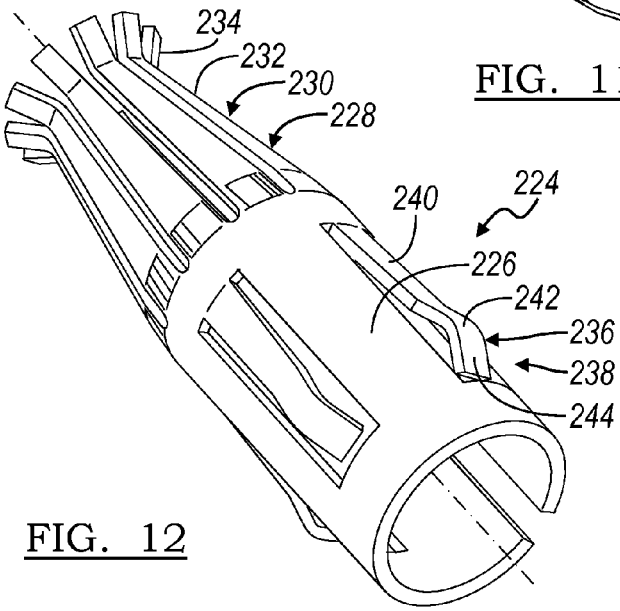
FIG. 12 is a side perspective view of a terminal according to another embodiment.

FIG. 12 illustrates a terminal 224 according to another embodiment. The terminal 224 has a body 226 formed from a sleeve. A radial array of leaf springs 228 extend from the body 226 at a distal region 230 with first and second angled portions 232, 234 for engaging a pin received within the receptacle 40. A second radial array of leaf springs 236 are formed into the body 226 at a proximal region 238 thereof, with lengthwise portions 240, first angled portions 242 and second angled portions 244 for engaging the side wall 78 of the receptacle 40. The leaf springs 236 are spaced circumferentially about the body 226. By orienting the leaf springs 236 about the body 226, the proximal region 238 and the body 226 are combined, thereby minimizing materials while optimizing conductivity.

Figure 13:
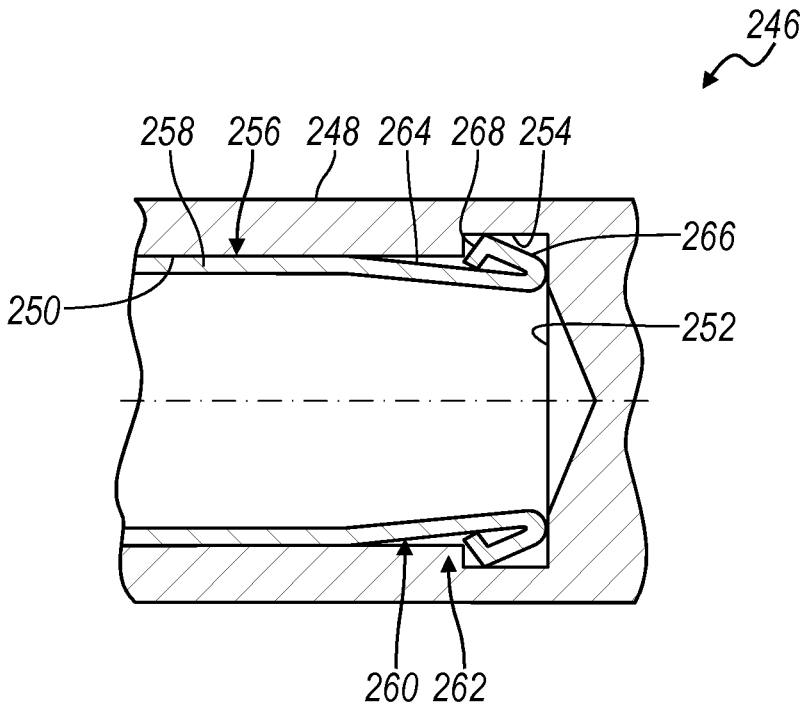
FIG. 13 is a partial section view of a receptacle assembly of FIG. 2 according to another embodiment.
Figure 14:
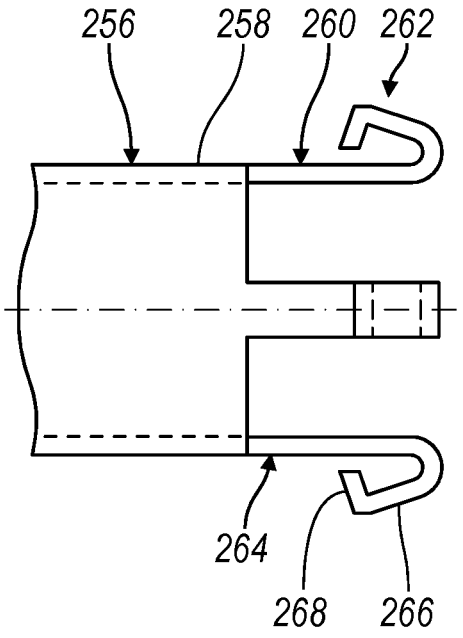
FIG. 14 is a partial side elevation view of a terminal of the receptacle assembly of FIG. 13.

FIG. 13 illustrates a receptacle assembly 246 according to another embodiment. The receptacle assembly 246 includes a receptacle housing 248 with a receptacle 250 formed to a blind depth end 252. A groove 254 is formed adjacent the blind depth end 252. The receptacle assembly 246 also includes a terminal 256 that is similar to prior embodiments. The terminal 256 is also illustrated in FIG. 14 and has a body 258 formed from a sleeve. A radial array of leaf springs 260 extend from the body 258 at a proximal region 262 with lengthwise portions 264, first angled portions 266 and second angled portions 268 for engaging the groove 254 of the receptacle 250 thereby providing additional contact points between the terminal 256 and the receptacle housing 248. The second angled portions 268 abut the lengthwise portions 264.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. A terminal comprising:

a body sized to be received within a receptacle;

a distal region extending lengthwise from the body in a receptacle direction, at least one portion of the distal region extending centrally inward into the receptacle to receive a pin to deform and maintain contact with the received pin; and a lengthwise extending proximal region connected to the body and spaced apart from the distal region, at least one portion of the proximal region extending radially outward to engage a side wall of the receptacle to enhance contact of the terminal with the receptacle;

wherein the proximal region comprises at least one leaf spring extending radially outward to engage the side wall of the receptacle;

wherein the leaf spring comprises a radial array of leaf springs; and wherein the radial array of leaf springs is spaced apart circumferentially by gaps formed therethrough that are generally equivalent to a corresponding width of the leaf springs.

2. The terminal of claim 1 wherein the proximal region extends from the body.

3. The terminal of claim 1 wherein the proximal region is oriented along the body.

4. The terminal of claim 1 wherein the radial array of leaf springs is spaced apart circumferentially by slits formed therethrough.

5. The terminal of claim 1 wherein the at least one leaf spring comprises:

a lengthwise extending portion; and an angled portion connected to the lengthwise extending portion.

6. The terminal of claim 5 wherein the leaf spring angled portion extends outboard relative to the lengthwise extending portion thereby increasing an outer dimension of the proximal region.

7. The terminal of claim 5 wherein the leaf spring angled portion extends along an external side of the lengthwise extending portion thereby increasing an outer dimension of the proximal region.

8. The terminal of claim 7 wherein the terminal is formed from a copper clad steel with a copper layer on an internal surface for contact with the pin; and wherein the leaf spring angled portion orients the copper layer to engage the receptacle housing.

9. The terminal of claim 1 wherein the terminal is formed integrally from a single sheet of stamped spring metal having a thickness, a length terminating at proximal and distal ends, and a width terminating at lateral ends; and wherein the sheet is rolled about a lengthwise axis such that the lateral ends are joined together.

10. The terminal of claim 9 wherein the lateral ends are welded together.

11. The terminal of claim 9 wherein the lateral ends are provided with interlocking features for joining the lateral ends together.

12. The terminal of claim 11 wherein the interlocking features comprise a semi-circular tab and a semi-circular recess.

13. The terminal of claim 11 wherein the interlocking features comprise a trapezoidal tab and a trapezoidal recess.

14. A receptacle assembly comprising:

a housing having at least one receptacle formed therein;

a terminal according to claim 1 received within the receptacle; and a retainer provided on the receptacle to retain the terminal therein.

15. The receptacle assembly of claim 14 wherein the terminal proximal region comprises at least one leaf spring extending radially outward to engage the side wall of the receptacle;

wherein the at least one leaf spring comprises:

a lengthwise extending portion, a first angled portion connected to the lengthwise extending portion to extend outboard relative to the lengthwise extending portion thereby increasing an outside dimension of the proximal region, and a second angled portion connected to the first angled portion and extending towards the lengthwise extending portion of the leaf spring to abut the lengthwise extending portion and maintain the first angled portion outboard of the lengthwise extending portion; and wherein the housing has a groove formed into the receptacle to receive the first and second angled portions of the leaf spring.

16. A terminal comprising:

a body sized to be received within a receptacle;

a distal region extending lengthwise from the body in a receptacle direction, at least one portion of the distal region extending centrally inward into the receptacle to receive a pin to deform and maintain contact with the received pin; and a lengthwise extending proximal region connected to the body and spaced apart from the distal region, at least one portion of the proximal region extending radially outward to engage a side wall of the receptacle to enhance contact of the terminal with the receptacle;

wherein the proximal region comprises at least one leaf spring extending radially outward to engage the side wall of the receptacle;

wherein the at least one leaf spring comprises:

a lengthwise extending portion, and an angled portion connected to the lengthwise extending portion;

wherein the leaf spring angled portion extends along an external side of the lengthwise extending portion thereby increasing an outer dimension of the proximal region;

wherein the terminal is formed from a copper clad steel with a copper layer on an internal surface for contact with the pin; and wherein the leaf spring angled portion orients the copper layer to engage the receptacle housing.

17. A receptacle assembly comprising:

a housing having at least one receptacle formed therein;

a terminal received within the receptacle, the terminal comprising:

a body sized to be received within a receptacle, a distal region extending lengthwise from the body in a receptacle direction, at least one portion of the distal region extending centrally inward into the receptacle to receive a pin to deform and maintain contact with the received pin, and a lengthwise extending proximal region connected to the body and spaced apart from the distal region, at least one portion of the proximal region extending radially outward to engage a side wall of the receptacle to enhance contact of the terminal with the receptacle; and a retainer provided on the receptacle to retain the terminal therein;

wherein the terminal proximal region comprises at least one leaf spring extending radially outward to engage the side wall of the receptacle;

wherein the at least one leaf spring comprises:

a lengthwise extending portion, a first angled portion connected to the lengthwise extending portion to extend outboard relative to the lengthwise extending portion thereby increasing an outside dimension of the proximal region, and a second angled portion connected to the first angled portion and extending towards the lengthwise extending portion of the leaf spring to abut the lengthwise extending portion and maintain the first angled portion outboard of the lengthwise extending portion; and wherein the housing has a groove formed into the receptacle to receive the first and second angled portions of the leaf spring.

* * * * *